US007780832B2

(12) United States Patent
Hasz

(10) Patent No.: US 7,780,832 B2
(45) Date of Patent: Aug. 24, 2010

(54) METHODS FOR APPLYING MITIGATION COATINGS, AND RELATED ARTICLES

(75) Inventor: Wayne Charles Hasz, Pownal, VT (US)

(73) Assignee: General Electric Company, Niskayuna, NY (US)

( * ) Notice: Subject to any disclaimer, the term of this patent is extended or adjusted under 35 U.S.C. 154(b) by 1018 days.

(21) Appl. No.: 11/289,925

(22) Filed: Nov. 30, 2005

(65) Prior Publication Data

US 2007/0119713 A1 May 31, 2007

(51) Int. Cl.
*C25D 13/02* (2006.01)

(52) U.S. Cl. ..... 204/490; 204/486

(58) Field of Classification Search ..... 204/490, 204/486

See application file for complete search history.

(56) References Cited

U.S. PATENT DOCUMENTS 4,321,311 A 3/1982 Stangman
4,960,433 A 10/1990 Renton
5,196,098 A 3/1993 Rodriguez et al.
5,514,482 A 5/1996 Stangman
5,521,029 A 5/1996 Fiorino et al.
5,531,872 A 7/1996 Forgit et al.
5,773,141 A 6/1998 Hasz et al.
5,851,678 A 12/1998 Hasz et al.
5,871,820 A 2/1999 Hasz et al.
5,925,228 A * 7/1999 Panitz et al. ..... 204/484
6,306,517 B1 10/2001 Gray et al.
6,482,537 B1 11/2002 Stangman et al.
6,627,323 B2 9/2003 Nagaraj et al.
6,887,361 B1 5/2005 Visco et al.
6,926,928 B2 8/2005 Ackerman et al.
7,422,671 B2 * 9/2008 Bhatia et al. ..... 204/487

* cited by examiner

*Primary Examiner*—Kishor Mayekar
(74) *Attorney, Agent, or Firm*—Francis T. Coppa

(57) ABSTRACT

A method for protecting a thermal barrier coating (TBC) which comprises voids is described. The method involves the step of electrophoretically depositing a mitigation coating material such as alumina to fill at least a portion of the voids. The TBC is often applied over a metal substrate, such as a turbine engine component. The voids can be in the form of vertical cracks within the TBC. A thermal barrier coating is also described, containing voids which extend into the coating from a top surface, wherein at least a portion of the voids is filled with a mitigation coating material.

13 Claims, 2 Drawing Sheets

METHODS FOR APPLYING MITIGATION COATINGS, AND RELATED ARTICLES

BACKGROUND OF THE INVENTION

This invention generally relates to metal components employed in a high-temperature environment. The invention is also directed to methods for maintaining the integrity of protective coatings for such metal components.

Many types of metals and metal alloys are used in industrial applications. When the application involves demanding operating conditions, specialty metals are often required. As an example, components within gas turbine engines operate in a high-temperature environment. Many of these components are formed from nickel-base and cobalt-base superalloys. Since the components must withstand in-service temperatures in the range of about 1100° C.-1150° C., the superalloys are often protected with thermal barrier coatings (TBC's).

The TBC's are typically formed of temperature-resistant ceramic materials such as yttria-stabilized zirconia. (In many cases, a metallic bond coat is applied between the TBC and the substrate). In the case of a turbine engine, the thermal barrier coatings are applied to various superalloy surfaces, such as turbine blades and vanes, combustor liners, and combustor nozzles. The TBC's can be applied over the component by various techniques. Non-limiting examples include physical vapor deposition (PVD); plasma spray techniques (e.g., air plasma spray); and high velocity oxy-fuel (HVOF).

The coefficient of thermal expansion (CTE) of a ceramic TBC and a metallic substrate can differ significantly. Thus, the thermal mismatch which is evident at elevated temperatures can result in damage to the TBC, and/or spallation of the coating from the substrate surface. To minimize the problems associated with such a thermal mismatch, the TBC is often provided with vertical channels or cracks (i.e., vertical to the coating surface). For example, a TBC deposited by a PVD process under selected conditions includes a pattern of substantially vertical microcracks. (Such a TBC is often said to have a "columnar microstructure"). The microcracks permit the TBC to expand and contract with the underlying metal, acting as a stress reliever. The resulting TBC can thus exhibit very good integrity during exposure to high temperatures and frequent thermal cycles. Moreover, TBC's deposited by plasma spray techniques such as air plasma spray (APS) can also contain vertical microcracks, although the microstructure is usually somewhat different from that formed by a PVD process. The vertical microcracks in the APS-applied TBC, as well as other porous regions usually formed in the coating by APS, can also serve as an effective stress reliever for thermal mismatches.

However, the integrity of the TBC can still be compromised under many conditions. For example, spallation of the coating can be promoted as a result of contact with various environmental contaminants. In the case of turbine engines used in aircraft (as well as land-based turbines), examples of the contaminants include, sand, dirt, volcanic ash, fly ash, cement, runway dust, substrate impurities, fuel and air sources, oxidation products from engine components, and the like. The environmental contaminants adhere to the surfaces of thermal barrier coated parts. The contaminant compositions may have melting ranges or temperatures at or below the operating temperature of the turbine component. In the case of a gas turbine engine operating at about 1000° C. or higher, the contaminant compositions often comprise calcium-magnesium-aluminum-silicon-oxide (CMAS) materials.

When a CMAS contaminant becomes molten at the operating temperature of the component, it can infiltrate the TBC. For example, the contaminant can migrate into the microcracks and other porous regions of the TBC. After infiltration and cooling, the molten CMAS (or other contaminant) solidifies. The resulting stress build-up within the coating—especially during additional thermal cycles—can result in spallation of the coating material. Thus, the thermal protection provided to the underlying part may be lost or seriously reduced.

Various techniques have been undertaken to address the problem. For example, a sacrificial oxide coating which reacts with the contaminant material can be applied over the TBC. (The sacrificial coating is sometimes referred to as a "mitigation coating", and is often an alumina or alumina-based material). As described in U.S. Pat. No. 5,773,141 (Hasz et al), the melting temperature and viscosity of the contaminant composition can increase when it reacts with the sacrificial coating. As a result, the contaminant composition does not become molten, and infiltration of the contaminant into the various cracks, openings and pores of the TBC is minimized or eliminated. Therefore, damage to the TBC can be significantly reduced.

Mitigation coatings have been applied by a number of processes, such as sol-gel, air plasma spray, sputtering, and vapor deposition techniques. A popular vapor deposition technique used for this purpose is the metal-organic chemical vapor deposition process, known as "MOCVD". As described in U.S. Pat. No. 6,926,928 (Ackerman et al), MOCVD is said to be a "non-line-of-sight" process, in which the oxide coating is deposited upon portions of the substrate that are not visible from an external source. Thus, very good coverage and protection of internal regions (e.g., cracks and pores within a TBC) can be attained. Moreover, MOCVD techniques can be carried out at relatively low substrate temperatures, e.g., in the range of about 350-950° C., which is a considerable processing advantage. Oxide coatings can be deposited to a well-defined thickness by MOCVD as well.

While there are certainly many advantages to using MOCVD to apply mitigation coatings, there are some disadvantages as well. For example, MOCVD can be a very expensive process. MOCVD systems often utilize large reactors, and need to contain a considerable number of other components, such as a vacuum system; a gas mixing cabinet, a cooling system, a heating system (e.g., an RF-generator), computer control systems, a scrubber, and a chiller. This type of system is often designed for handling large numbers of substrates, i.e., components which are being coated. Thus, in terms of efficiency and economy, large MOCVD systems may not be well-suited for handling individual substrates, or small numbers of substrates. Moreover, MOCVD techniques sometimes require relatively long process times, which may not always be ideal.

With these considerations in mind, new methods for applying mitigation coatings over TBC's which include various types of open regions or voids would be welcome in the art. The methods should be capable of at least partially filling the voids with coating material which inhibits the movement and deleterious effects of various contaminant compositions. The methods should also be relatively efficient, and adaptable to economically treating individual substrates coated with the TBC's, or small numbers of the substrates.

BRIEF DESCRIPTION OF THE INVENTION

One embodiment of this invention is directed to a method for protecting a thermal barrier coating (TBC) which comprises voids. The method comprises the step of electrophoretically depositing a mitigation coating material to fill at least a portion of the voids.

Another embodiment relates to a thermal barrier coating comprising voids which extend into the coating from a top surface of the coating, wherein at least a portion of the volume of the voids is filled by a mitigation coating material.

Other features and advantages of the present invention will be more apparent from the following detailed description of the invention.

DETAILED DESCRIPTION OF THE INVENTION

Figure 1:
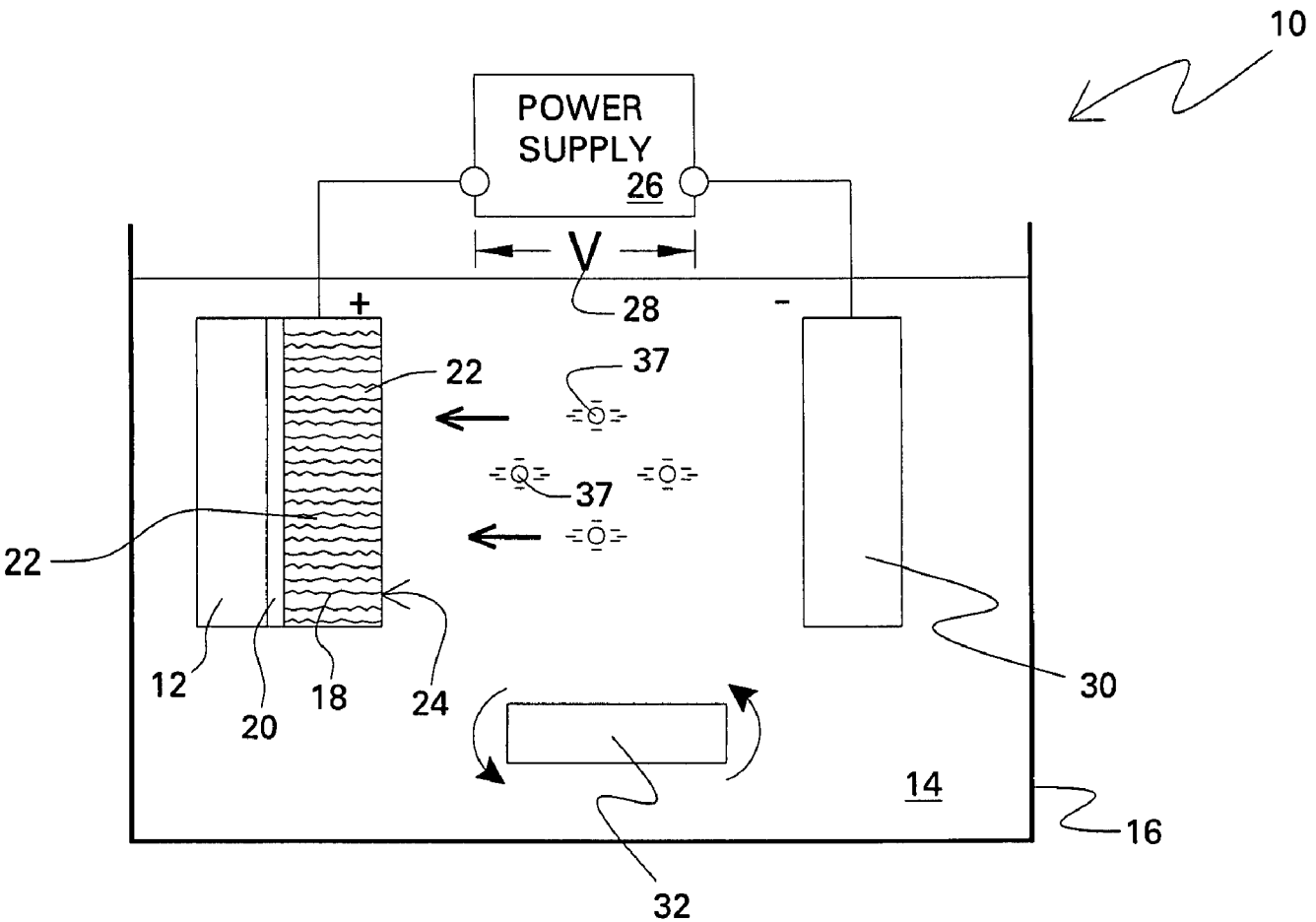
FIG. 1 is a schematic representation of an exemplary electrophoretic deposition system.

The mitigation coating used for most embodiments of this invention can comprise a variety of materials. Many are described in U.S. Pat. No. 6,627,323 (Nagaraj et al), as well as in three patents issued to Hasz et al: U.S. Pat. Nos. 5,660,885; 5,871,820; and 5,914,189. All of these patents are incorporated herein by reference. In those instances in which the contaminant is a CMAS-type composition, the mitigation material can often be characterized as one which is impermeable, sacrificial, or non-wetting to CMAS, as described in U.S. Pat. No. 6,627,323. Typically, the mitigation material is a metal oxide, e.g., a single oxide, a mixed oxide, or combinations thereof. Non-limiting examples of the single oxides are as follows: alumina, magnesia, chromia, calcia, scandia, silica, and various rare earth oxides. Non-limiting examples of the mixed oxides are as follows: zirconates (e.g., calcium zirconate, gadolinium zirconate, or neodymium zirconate); various alumino-silicates, spinels, and mixtures thereof. Choice of a particular material will depend on various factors, such as the particular composition of the substrate; the composition and thickness of the TBC, the manner in which the TBC is applied; the particular type of EPD equipment employed; electrical charge characteristics for the material; and the chemical characteristics of the contaminant. In some preferred embodiments, the mitigation material is alumina or an alumina-containing composition, e.g., alumina-silica. It should also be noted that the mitigation coating can be used in various forms of the oxide, e.g., alpha, beta, or gamma forms. Moreover, forms other than oxide may be employed, e.g., hydroxides like gibbsite or boehmite.

In many embodiments, the mitigation material is in the form of fine particulates, e.g., nanoparticles. The most appropriate size of the materials will depend on various factors. They include: the size of the voids within the TBC (e.g., the average width of vertical microcracks); the specific mitigation material employed; and the colloidal stability of the particles of the nanomaterial. Usually, the average particle size of the mitigation material is in the range of about 1 nm to about 10,000 nm (10 microns). In the case of alumina or alumina alloys, the average particle size is in the range of about 10 nm to about 1000 nm. As discussed herein, in those cases in which the vertical microcracks are present, the particles should be small enough to allow passage through at least a substantial portion of the length of the microcracks. The desired size of the coating particles can be obtained by using conventional grinding techniques; e.g., milling; precipitation from solution; and the like.

As mentioned above, the mitigation coating is formed over the surface of the TBC by electrophoresis. As used herein, the terms "electrophoresis", "electrophoretically", and "electrophoretic deposition" (EPD) refer to the movement or migration of charged, suspended particles in a liquid, due to the effect of a potential difference between at least two partially immersed electrodes. The migration of the particles is in the direction of the electrode (the substrate being coated) which has a charge opposite to that of the particle. Particles lose their charge at the electrode and tend to accumulate there. In electrophoresis, the ability to control deposition of the material is primarily due to the particles losing their charge when they reach the electrode. Since the electrical resistance of the coating increases with deposition thickness, the process is generally self-limiting. EPD is known in the art and described in various references. Examples include U.S. Pat. No. 5,531,872 (Forgit et al); U.S. Pat. No. 5,521,029 (Fiorino et al); and U.S. Pat. No. 6,887,361 (Visco et al), which are all incorporated herein by reference.

An exemplary apparatus 10 for EPD is depicted in FIG. 1, adapted to deposit a mitigation coating on a thermal barrier coating. A substrate 12 is immersed in a liquid medium 14, contained in any suitable vessel 16. The substrate can be in the form of a variety of metal components, or portions of components. In some specific embodiments, the substrate is a turbine engine component. Non-limiting examples include blades, buckets, nozzles, rotors, disks, vanes, stators, shrouds, combustors and blisks.

A TBC 18 lies over a surface of substrate 12. A wide variety of TBC's can be used. TBC's for many high temperature components (e.g., turbine engine blades) are typically formed of ceramic materials. Non-limiting examples include zirconia and zirconia-based materials. A typical thermal barrier coating comprises about 8 weight % yttria and about 92 weight % zirconia. The thickness of the thermal barrier coating depends on the application, but generally ranges between about 25 microns to about 2500 microns (about 1 mil to about 100 mils) for high temperature engine parts. The TBC 18 is usually (but not always) applied over a metallic bond coat 20. The bond coats are usually conventional, and often comprise diffusion aluminide materials or MCrAl(X) materials, as described in U.S. Pat. No. 6,861,157 (Zhao et al), which is incorporated herein by reference.

As mentioned previously, the TBC contains voids. As used herein, the term "void" is meant to include regions in the coating which contain any type of crack, cavity, pore, interstice, or other type of opening. Very often, the type and shape of the void is determined by the manner in which the TBC was deposited. As also discussed above, a TBC deposited by a PVD process under selected conditions includes a pattern of substantially vertical (e.g., columnar) microcracks. ("Microcracks" is interchangeably used herein with "cracks". A microcrack in this instance is typically a crack with a width of less than about 50 microns). TBC's deposited by air plasma spray can also include vertical cracks, as well as other types of porosity. Vertical cracks 22 are illustrated in FIG. 1, and they extend to the top surface 24 of TBC 18.

A power supply 26 is used to generate a voltage 28 between an anode 30 and a cathode 12, i.e., the substrate. The anode can be formed of a variety of conductive materials, and is usually a metal or metal alloy such as stainless steel, aluminum, or platinum. As further described below, the cathode and the anode are immersed in a suspension of the mitigation coating particles. When a voltage is applied, the charged coating particles are attracted to the deposition surface 12 (i.e., the cathode in this instance), and thereby deposit themselves on TBC surface 24.

Liquid medium or "bath" 14 can be formed of many different components. In general, any liquid system which can support a stable dispersion of charged coating particles may be employed. Those of ordinary skill in the art of electroplating and similar technology are familiar with many of the details regarding these types of baths. (As but one example, electrocoating technology, used to apply primer paints to automobiles, has many similar features).

The coating particles are usually suspended within the liquid medium. The suspension of coating particles can be supplied to vessel 16 in prepared form, or it can be generated in situ, by known techniques. Two principal types of solvents are typically used: water and organic liquids. The type of solvent employed will depend in part on the coating particle being dispersed therein. For example, aqueous dispersions are often very suitable when handling considerations are especially important. Organic solvents are sometimes preferred when there is concern that a particular aqueous suspension may cause undesirable gas formation from the hydrolysis of water.

General, non-limiting examples of organic solvents are hydrocarbons (including halogenated hydrocarbons), alcohols, esters, ethers, ketones, and various combinations thereof. (Moreover, combinations of aqueous solvents and organic solvents can sometimes be employed. For example, an aqueous medium could contain water and at least one coalescing solvent, e.g., a hydrocarbon or alcohol). Those skilled in the art will be able to readily determine which specific solvents or solvent mixtures are most suitable i.e., those having dielectric constant values and conductivity characteristics appropriate for efficient electrophoretic deposition.

As alluded to previously, in a typical EPD technique, the substrate is placed in a liquid dispersion of charged coating particles, and a voltage is applied to the liquid system. (As mentioned elsewhere in this disclosure, coating particles can become charged by various means. Examples include: reaction with the solvent (often pH-dependent in the case of aqueous solvents); and the incorporation of specific ions or charged surfactants). The charged particles to be deposited migrate toward the electrode with the opposing charge (i.e., the substrate). In one embodiment of the present invention, the negatively charged particles migrate toward the positive electrode. The positive electrode is the collector on which the coating of oxide particles is formed. Therefore, the liquid dispersion must provide conditions under which the coating particles will migrate toward the collector when a voltage is applied thereto. In other embodiments, positively charged particles migrate toward the negative electrode, and the configuration of the EPD apparatus is modified accordingly (e.g., the polarity of the deposition surface is reversed). In each instance, the surface charge of the particles can be adjusted to achieve the desired objective.

Those skilled in the art are familiar with aqueous techniques for modifying the surface electrical charge (sometimes referred to as the "zeta potential") for a particular type of coating particle. For example, when the liquid system comprises an aqueous dispersion, the pH of the system can be readily adjusted. The adjustment can be made with respect to the isoelectric point of the particles (i.e., the pH at the point of zero-charge), since the appropriate pH will provide the desired environment to facilitate the migration of the coating particles toward the particular electrode. As an illustration, a positive surface charge on a particle can be obtained by lowering the pH of the liquid dispersion, to below the isoelectric point. This can be carried out, for example, by adding an acid. A strong acid like hydrochloric acid or sulfuric acid could be used for this purpose, as well as organic acids (e.g., acetic acid) which have an appropriate acidity constant $pK_a$. Conversely, a negative surface charge on a particle can be obtained by increasing the pH of the liquid dispersion to above the isoelectric point, e.g., by adding a base such as sodium hydroxide and the like. (As described in U.S. Pat. No. 5,521,029, particular acids can sometimes influence particle charge to a different degree, even at the same pH, and this phenomenon should be taken into consideration in designing the most appropriate deposition system). Typically, the pH is maintained at about 2-3 pH units above or below the isoelectric point of the material which is being deposited.

Moreover, the electrical charge for the particles can be modified by other techniques, e.g., the use of conventional surfactants which adsorb on the particle surface. In general, those of ordinary skill in the art will be able to determine the most appropriate pH for a particular type of particle and a particular type of liquid system used for EPD. The best way to obtain that pH can then be determined without undue effort. A variety of references discuss various other factors involved in designing an EPD system, e.g., factors such as the required bath stability; bath temperature; the isoelectric point of the particular coating particle; and agitation techniques employed (e.g., ultrasonic agitation for producing a more uniform dispersion of particles).

In some specific embodiments, the liquid medium of the EPD system comprises a colloidal suspension. As used herein, the term "colloidal suspension" is meant to embrace any dispersion of fine particles of the coating material in a medium of water or another solvent. Selection of a particular solvent will depend on various factors, such as: its dielectric constant; its conductivity, the "dispersability" of powders in the solvent; its evaporation rate; the solubility of additives and other components in the solvent; and the solvent's ability to wet the substrate. Other factors which may deserve consideration are handling requirements; cost requirements; and environmental/safety requirements. As with other liquid mediums, the colloidal suspension can include a variety of additives. Non-limiting examples include dispersants, deflocculants, anti-settling agents, anti-foaming agents, binders, and surfactants. In general, the additives are used at a level in the range of about 0.001% by weight to about 10% by weight, based on the weight of the entire composition.

Many of the metal oxide materials mentioned above can be used in the form of a colloidal suspension. Non-limiting examples include colloidal forms of alumina, silica, zirconia, calcia, scandia, and titania. Those skilled in the art (for example, the slip casting arts) are familiar with methods for preparing the colloidal suspensions, based in part on some of the considerations mentioned herein. As alluded to previously, the pH of the colloidal suspension is brought within a desired range by conventional methods, so as to optimize the suspension-stability and deposition efficiency of the coating material on the substrate. As one illustration in the case of commonly-used alumina particles suspended in an aqueous medium, a pH in the range of about 2 to about 5 is usually best for causing the migration of positively charged particles toward a negative electrode. Under similar conditions for commonly-used silica particles, a pH in the range of about 4 to about 10 might be ideal (with the variations mentioned above, relative to an isoelectric point). As described for U.S. Pat. No. 5,521,029 (Fiorino), a pH of about 1 to about 3 might be ideal for positively-charged titanium oxide particles migrating toward a negative electrode in an aqueous bath. (FIG. 1 illustrates the situation wherein negatively-charged particles 37 migrate toward a positive electrode, i.e., the substrate).

As also mentioned above, zeta potential can be an important factor in designing the deposition system. As described in the Fiorino patent, the zeta potential of the particles is related to the pH of the aqueous medium. Thus, in the case of positively-charged titanium particles, the zeta potential of the particles goes from positive to negative, moving past the isoelectric point, at a pH of about 5. Particles with a negative zeta potential will not deposit on a negative cathode. Those skilled in the art are capable of adjusting coating particle size and all bath conditions to account for these factors.

Moreover, it should be understood that many suitable colloidal suspensions are commercially available. For example, there are a variety of Nyacol® colloidal alumina products (e.g., Nyacol® Al-20) available from Nyacol Nano Technologies, Inc., Ashland, Mass. Colloidal alumina and colloidal silica products are also available from Allied High Tech Products, Inc., Rancho Dominguez, Calif. There are also many other commercial sources for metal oxide suspensions, with different grades available, depending on characteristics such as pH, solvent composition, particle size, additive content, and the like.

Other conventional details regarding EPD techniques can be briefly described. With reference to FIG. 1, the top surface 24 of thermal barrier coating 18 can be cleaned with deionized water or an appropriate organic solvent, prior to submersion of substrate 12 into liquid bath 14. After the power supply 26 is turned on, the most appropriate coating rate can be determined. In general, the deposition rate for the mitigation coating is proportional to the voltage which is applied. At a constant voltage, the current passing through the bath may tend to decrease as more coating material is deposited. Typically, at an applied voltage of about 1-300 volts, the deposition of the coating material will be complete in about 5 seconds to about 500 minutes, although there may be wide variation in this deposition rate. The use of higher initial voltages (and thus, the passing of higher current densities) may increase the deposition rate somewhat. However, in the case of aqueous deposition, the higher voltage levels may also lead to the formation of gas bubbles within the mitigation coating itself, which is undesirable. Thus, care should be taken in adjusting voltage and current, and monitoring coating quality and deposition rate. In order to prevent settling, the bath can be stirred, e.g., using magnetic stir bar 32.

The amount of coating material dispersed in liquid medium 14 will depend on many of the other factors considered herein. Some of the primary factors include the type of EPD system; the solvent-content; the size of the coating particles; their inherent colloidal stability; and the critical particle concentration (CPC). Usually (but not always), the solids-loading is in the range of about 0.001 volume % to about 10 volume %, based on the volume of particles, per total volume of suspension. (As shown in FIG. 1, the substrate is often positioned so that the openings in the TBC coating are readily accessible to the electrophoretic-induced movement of the mitigation coating material particles. However, this position is not always required).

As the EPD process continues, at least a portion of the voids (e.g., cracks 22 in FIG. 1) become filled with the mitigation coating. (FIG. 1 does not show the coating material in the cracks). The degree to which the voids become filled depends on many factors, such as the type and shape of void; the type of TBC and the type of mitigation coating; the intended end use for the article protected by the TBC; and the specific type of EPD system employed. Usually, at least about 5% to about 95% of the total volume of the cracks will be filled with mitigation coating material. In some specific embodiments, at least about 50% of the total volume of the cracks would be filled. In the case of TBC's with vertical microcracks, the amount of mitigation coating material which is incorporated into the cracks is usually that which is sufficient to react with the contaminants which are present at or near the surface of the TBC, to prevent their entry into the interior of the TBC. However, in some instances, it may be desirable to avoid completely filling the open regions of the crack (i.e., eliminating all open space), since such an occurrence could lower the overall compliancy of the TBC. (It should be understood that each crack would not be filled with an identical amount of mitigation coating material).

After the voids have been filled or partially filled, the EPD process usually (but not always) continues until a surface coating (not shown) is formed over top surface 24 of TBC 18. The optional surface coating functions as an additional barrier to the entry of CMAS and other contaminants into the porous regions within coating 18. The thickness of the coating can vary widely, depending on many of the other factors described herein. Usually, the surface coating will have a thickness in the range of about 0.01 micron to about 100 microns. In some specific embodiments, the thickness is in the range of about 1 micron to about 20 microns. After the coating has been deposited to a desired thickness, the power can be turned off. The substrate can then be removed from the EPD bath, and heat-treated to harden the deposited coating.

As described previously, alumina mitigation coatings have been applied over TBC's by MOCVD processes. Although such coatings may have infiltrated to some extent into the vertical microcracks of a TBC, it is thought that the mitigation coatings may not have filled a substantial portion of the volume of the cracks, e.g., 50% or more of the volume. (In fact, the coating material may have purposely been used to coat only the interior walls of the cracks). Thus, another embodiment of the present invention is directed to a TBC which includes microcracks, in which at least about 50% of the volume of the microcracks is filled with an alumina or alumina-based material. (As used herein, "alumina-based" generally refers to materials which contain at least about 50 weight % alumina).

Moreover, another embodiment of the invention relates to a TBC which includes microcracks, wherein at least some portion of the microcracks is filled with other types of mitigation materials (i.e., other than alumina itself, as a single oxide). Suitable materials include those capable of reacting with contaminants like CMAS, so as to prevent or minimize the entry of the contaminants into the microcracks. Non-limiting examples of these mitigation materials were described previously, e.g., magnesia, chromia, calcia, scandia, silica, various rare earth oxides, mixed oxides such as zirconates; various alumino-silicates, spinels, and mixtures thereof.

Figure 2:
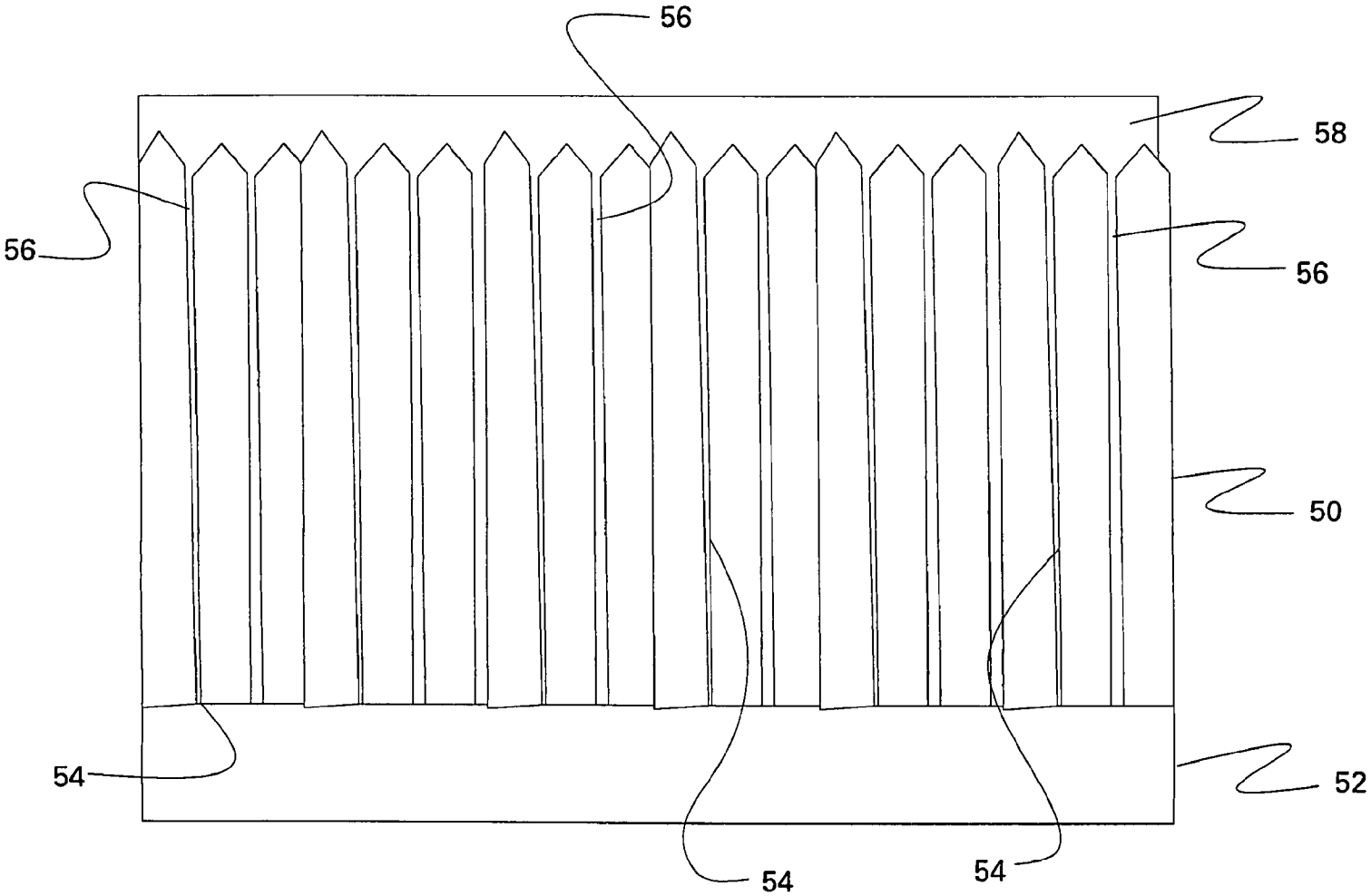
FIG. 2 is a depiction of the cross-section of a thermal barrier coating system over which an aluminum oxide mitigation coating has been applied.

FIG. 2 is a cross-sectional depiction of a thermal barrier coating (TBC) 50, applied over an alumina-based bond coat 52. The figure is generally representative of a microprobe image obtained for an actual sample. The TBC had a thickness of about 150 microns. (The coating system was applied on a metallic test coupon). The TBC was applied by physical vapor deposition, and the coating contained a series of vertical microcracks 54. An alumina-based mitigation coating material 56 was deposited by an EPD process, using an apparatus similar to that of FIG. 1 (with the polarity of the deposition system reversed). For the actual test sample, coating material 56 filled a substantial portion of the various microcracks 54, reaching a depth of about 100-150 microns from the top surface of the TBC. The alumina coating material also formed a surface layer 58 over the outer surface of TBC 50, having a thickness of about 10 microns, and covering the openings into the microcracks.

EXAMPLES

The examples which follow are merely illustrative, and should not be construed to be any sort of limitation on the scope of the claimed invention.

Example 1

Various sets of metallic test coupons were coated by physical vapor deposition with a conventional yttria-stabilized zirconia thermal barrier coating (TBC), to a thickness of about 5 mils (127 microns). An EPD apparatus similar to that of FIG. 1 was then used to apply mitigation coatings over the TBC's (with the polarity of the deposition reversed, i.e., to deposit positively-charged particles on a negative electrode). The coating bath was a colloidal alumina suspension in deionized water, available from Nyacol Nano Technologies, Inc., (Nyacol® AL-20). The average particle size for the alumina was about 20 nm. The bath contained nitric acid in an amount sufficient to maintain a pH of about 4. The voltage level for the bath ranged from 0.2 to 40 volts DC. Immersion time for the test coupons ranged from about 1 minute to about 1 hour.

After being air-dried and heat-treated at 1000° C. for about 1 hour, the effectiveness of the mitigation coatings was evaluated. First, a tape of CMAS-material was applied to the coated button. The button was then furnace cycle-tested (FCT) at a temperature of about 2250° F. (1232° C.), for about 1 hour.

Furnace cycling was repeated until failure of the TBC occurred. The furnace cycle life for the various coupons varied from about 5 cycles to about 15 cycles, without significant failure of the TBC. The best coupons exhibited FCT lives of about 15 cycles, which was comparable to the results for coupons coated by way of a conventional MOCVD process. (Coupons without the mitigation coatings failed in about 2-3 cycles).

Example 2

Gas turbine blades were also provided with a mitigation coating, using the apparatus described above. (Each blade had been previously coated with a yttria-stabilized zirconia coating). A circular counter electrode was provided with a 1 inch (2.54 cm) stand-off from the pressure side of a jet engine blade. The deposition conditions for the coating were generally similar to those in Example 1. (Electrical contact was made with the blade via its dovetail cooling circuit). As in Example 1, furnace cycling tests demonstrated FCT lives which ranged from about 5 cycles to about 15 cycles, without significant failure of the TBC. (Blades without the mitigation coatings failed in about 2-3 cycles).

Other modifications of the present invention may occur to those skilled in the art, based upon a reading of the present disclosure. These modifications are intended to be included within the scope of the present invention. Moreover, all of the patents, patent applications, and other articles which may be mentioned above are incorporated herein by reference.

What is claimed is:

1. A method for protecting a yttria-stabilized zirconia thermal barrier coating (TBC) which comprises voids from an environmental-contaminant material, comprising the steps of electrophoretically depositing a mitigation coating material to fill at least a portion of the voids in the yttria-stabilized zirconia thermal barrier coating, and contacting the thermal barrier coating with the environmental-contaminant material so that the mitigation coating material is capable of reacting with the contaminant material to raise the melting point of the contaminant material and/or increase its viscosity.

2. The method of claim 1, wherein the voids comprise vertical cracks.

3. The method of claim 1, wherein the mitigation coating material comprises metal oxide particles, metal hydroxide particles, or combinations thereof.

4. The method of claim 3, wherein the mitigation coating is at least one material selected from the group consisting of single oxides and mixed oxides.

5. The method of claim 4, wherein the single oxides are selected from the group consisting of alumina, magnesia, chromia, calcia, scandia, rare earth oxides, and combinations thereof.

6. The method of claim 4, wherein the mixed oxides are selected from the group consisting of calcium zirconate, gadolinium zirconate, neodymium zirconate, alumino-silicates, spinels, and combinations thereof.

7. The method of claim 1, wherein the environmental-contaminant material comprises calcium oxide, magnesium oxide, aluminum oxide, and silicon oxide.

8. The method of claim 1, wherein the mitigation material is also deposited over the surface of the TBC, to form a surface coating.

9. The method of claim 1, wherein the thermal barrier coating is disposed over a metal substrate.

10. The method of claim 9, wherein the metal substrate is a turbine engine component.

11. The method of claim 9, wherein the mitigation coating material is formed by placing the thermal barrier-coated substrate in a colloidal dispersion of coating material particles selected for the coating composition, and electrophoretically depositing the coating material to fill at least a portion of the voids.

12. The method of claim 11, wherein the metal substrate is positioned in the colloidal dispersion so that the TBC surface openings to the voids are readily accessible to electrophoretic-induced movement of the mitigation coating material particles within the dispersion.

13. The method of claim 11, wherein the coating material particles comprise alumina, and have an average particle size in the range of about 10 nm to about 1000 nm.

* * * * *